US009099257B2

(12) United States Patent
Bonetti et al.

(10) Patent No.: US 9,099,257 B2
(45) Date of Patent: Aug. 4, 2015

(54) MOVING ELEMENT FOR A LOW VOLTAGE SWITCHING DEVICE AND SWITCHING DEVICE COMPRISING THIS MOVING ELEMENT

(75) Inventors: Luigi Bonetti, Bergamo (IT); Michele Ferrari, Bergamo (IT)

(73) Assignee: ABB S.p.A., Milano (IT)

( * ) Notice: Subject to any disclaimer, the term of this patent is extended or adjusted under 35 U.S.C. 154(b) by 667 days.

(21) Appl. No.: 13/142,780

(22) PCT Filed: Dec. 29, 2009

(86) PCT No.: PCT/EP2009/067998

§ 371 (c)(1),
(2), (4) Date: Jun. 29, 2011

(87) PCT Pub. No.: WO2010/079106

PCT Pub. Date: Jul. 15, 2010

(65) Prior Publication Data

US 2011/0266121 A1 Nov. 3, 2011

(30) Foreign Application Priority Data

Jan. 8, 2009 (IT) ..... MI2009A0011

(51) Int. Cl.

| | |
|---|---|
| ***H01H 1/22*** | (2006.01) |
| ***H01H 77/10*** | (2006.01) |
| *H01H 71/10* | (2006.01) |

(52) U.S. Cl.

CPC ..... *H01H 1/225* (2013.01); *H01H 71/1009* (2013.01); *H01H 2001/223* (2013.01); *H01H 2071/1036* (2013.01)

(58) Field of Classification Search

CPC ..... H01H 77/10; H01H 73/04; H01H 23/02; H01H 23/16; H01H 73/06; H01H 1/22

USPC ..... 200/275, 401, 244, 250

See application file for complete search history.

(56) References Cited

U.S. PATENT DOCUMENTS

| | | | | |
|---|---|---|---|---|
| 4,841,266 | A * | 6/1989 | Wulff | 335/16 |
| 5,469,121 | A * | 11/1995 | Payet-Burin | 218/22 |
| 5,539,167 | A * | 7/1996 | Hood et al. | 200/244 |

FOREIGN PATENT DOCUMENTS

| | | |
|---|---|---|
| EP | 0 619 593 | 10/1994 |
| JP | 02106841 A | 4/1990 |
| WO | WO-9522165 A1 | 8/1995 |

* cited by examiner

*Primary Examiner* — Amy Cohen Johnson
*Assistant Examiner* — Marina Fishman
(74) *Attorney, Agent, or Firm* — Novak Druce Connolly Bove + Quigg LLP

(57) ABSTRACT

The present invention relates to a moving element for a low voltage switching device and to a switching device comprising this moving element. The moving element according to the invention comprises for each pole a housing unit suitable to receive an elastic element which interacts with an electrical contact. This latter comprises a first contact portion susceptible to contact a further electrical contact and a second portion connectable to a conductive element of the switching device. The electrical contact comprises a pin shaped portion positioned rotating in a seat defined on the housing unit so as to configure a mutual rotation axis of the electrical contact with respect to the housing unit.

20 Claims, 14 Drawing Sheets

MOVING ELEMENT FOR A LOW VOLTAGE SWITCHING DEVICE AND SWITCHING DEVICE COMPRISING THIS MOVING ELEMENT

CROSS REFERENCE TO RELATED APPLICATIONS

This application is a National Phase filing under 35 U.S.C. §371 of PCT/EP2009/067998 filed on Dec. 29, 2009; and this application claims priority to Application No. MI2009A000011 filed in Italy on Jan. 8, 2009 under 35 U.S.C. §119; the entire contents of all are hereby incorporated by reference.

The present invention relates to a moving element for a low voltage switching device and to a switching devices comprising this moving element.

It is known that low voltage switching devices (i.e. for applications with operating voltages up to 1000V AC/1500V DC), such as automatic circuit-breakers, disconnectors and contactors, universally called switching devices and subsequently called switches for the sake of brevity are devices conceived to permit correct operation of specific parts of electrical systems and of the loads installed. For example, automatic circuit-breakers ensure that the rated current required can flow towards the various utilities, allowing correct connection and disconnection of the loads from the circuit and automatic sectioning of the circuit protected with respect to the electrical power source.

Devices that allow abnormal operating conditions of a specific branch of a system to be recognized and consequent action to be taken with the opening of at least one of the switches present in the circuit are normally known as protective devices. The most widely used protective devices are of the thermal, magnetic, thermal magnetic or electronic type, also in combination with one another.

It is known that switches comprise a case, one or more electric poles, associated with each of which is at least one pair of contacts which can be coupled with and decoupled from each other. Prior art switches also comprise an actuating mechanism which causes the relative movement of said pairs of contacts so that they can assume at least a first coupling position (switch closed) and at least a separated position (switch open). In a large number of prior art solutions the action of the actuating mechanism on the moving contacts is conventionally performed through a moving element from which the moving contacts directly protend. Operating connection between the actuating mechanism and this moving element conventionally takes place by means of a kinematic chain.

The structure of moving elements currently employed in switches presents various drawbacks. In fact, it is known that moving elements are rotating members, which essentially comprise a shaped body, generally made of insulating material, which defines housing units configured to house at least one moving contact of one or more poles of the switch. The moving elements according to this conception, which can be single-pole or multi-pole, also comprise retaining and operating coupling means for the moving contacts, hinges or bearing sections to define a rotation axis, and means for operating coupling with the actuating mechanism. The operating connection between the moving contacts and the moving element provides for the use of joining means in positions difficult to access and thus critical to assemble or detach.

In fact, as it is known, during the working life of the switch each of its components is subject to deterioration or wear, for example due to the considerable thermal and mechanical stresses to which the automatic circuit-breaker or disconnector is normally subjected, during switching operations or tripping due to short circuit. However, the operating efficiency of the switch depends on the perfect state of repair of all its parts. Therefore, on the basis of the state of effective efficiency, it may become necessary to perform difficult and costly maintenance operations.

In particular, it is currently possible to replace or remove the moving contacts only through specific operating procedures that lie outside the normal domain of an operator trained to carry out maintenance.

Another drawback of conventional switches is represented by the fact that the fixing pins normally used to fasten the moving contacts to the moving elements are generally made of metal. The presence of metal parts in the vicinity of poles can clearly negatively influence the overall insulation (or galvanic separation) between adjacent poles. In fact, these pins typically extend parallel to the rotation axis of the moving element, and thus tend to protend towards any adjacent poles. Moreover, the pins relative to moving contacts or to adjacent poles are placed along a same axis (i.e. the relative rotation axis between moving contacts and moving element), and contiguous pins are separated from one another only by short gaps formed by air or by insulating material. In the most common case this is air, as for assembly reasons the various pins present are inserted using a single hole, which passes axially through the entire moving element (rotation axis).

A further drawback is again linked to the presence of the pins: in fact, besides compromising the stability of the contacts, possible undesirable axial movements of the pins along their operating seat determine further decays of the insulation between adjacent poles.

Yet another drawback of prior art joins between contact and moving element derives from the considerable costs for the production of pins with adequate characteristics, for their assembly and to ensure they are retained stably in the seats provided (for example with threads or with the addition of further retaining means).

On the basis of these considerations, the main aim of the present invention is to provide a moving element for a low voltage switching device which allows the aforesaid drawbacks to be overcome, in particular in which the operating connection between the moving contacts and this moving element can be produced in a simple and reliable manner, without complex coupling, clamping and adjusting operations.

This aim is achieved through a moving element for a low voltage switching device according to the indications in the appended claims. A further object of the present invention is to provide an electrical contact for a low voltage switching device.

In the description reference will be made to a moving element for a single break multi-pole low voltage switching device. Naturally, it must be understood that the principles and the technical solutions set forth within the scope of the description of the inventive concept are also valid for other applications such as a single-pole moving element (for single-pole or multi-pole devices) or moving elements intended for double break switching devices. The principles and the technical solutions set forth below are also valid for a moving element intended for a switching device comprising a plurality of moving elements, each of which relative to a specific pole.

Further characteristics and advantages will be more apparent from the description of a preferred but non-exclusive embodiment of the moving element according to the present invention, illustrated by way of non-limiting example in the accompanying figures, in which.

Figure 1:
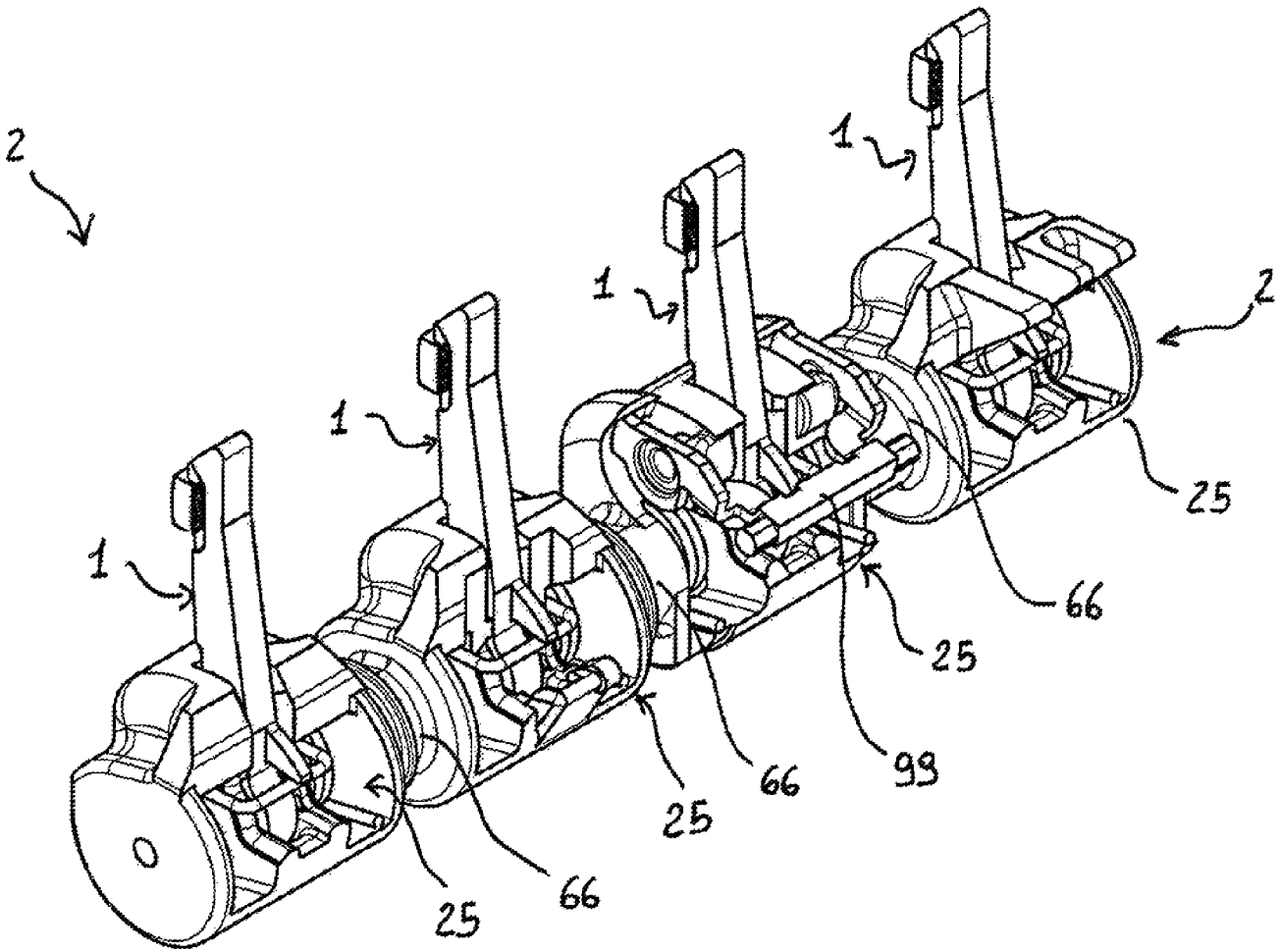
FIG. 1 is a perspective view relative to a moving element according to the present invention.

FIG. 1 is a view relative to a first embodiment of a moving element 2 according to the present invention. The moving element 2 comprises a plurality of housing units 25, each housing an electrical contact 1 and at least one elastic element 50 which interacts with the electrical contact 1. The moving element 2 shown in FIG. 1 is intended for a four-pole switching device (see FIGS. 27 and 28) and for this reason comprises four housing units 25 each for housing an elastic element 50 which interacts with a corresponding electrical contact 1 to maintain this in a pre-established position with respect to the relative housing unit 25, and to adjust the contact pressure. At the same time, the elastic element 50 has the function of opposing the electrical repulsive force to which the electrical contact 1 can be subjected, in substance stabilizing this contact.

Figure 2:
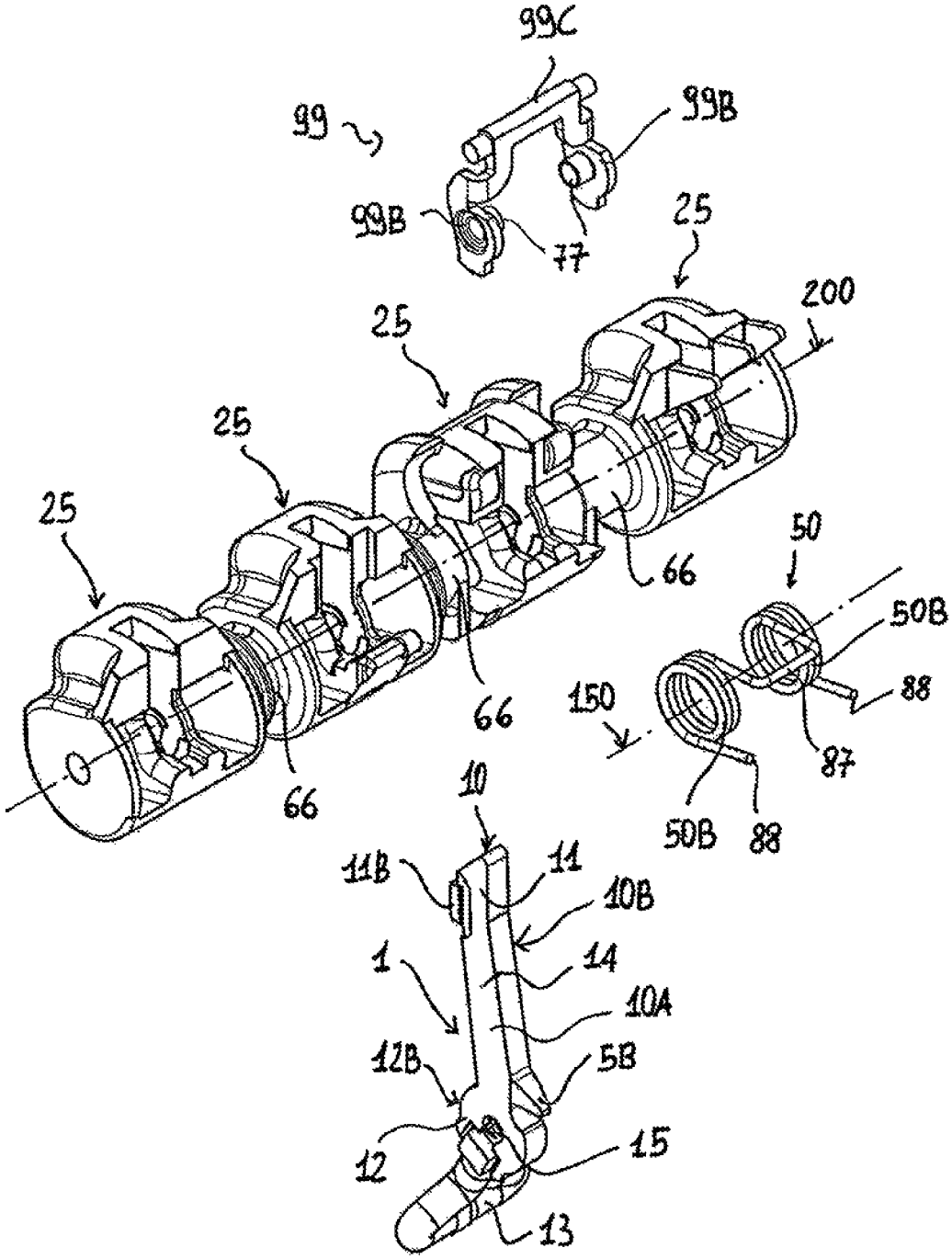
FIG. 2 is an exploded view relative to the moving element of FIG. 1.

FIG. 2 is an exploded view of the moving element 2 of FIG. 1 and shows an electrical contact 1 and the relative elastic element 50 relative to one of the housing units 25 of the moving element 2. As is evident from the figure, the housing units 25 are in substance adjacent portions of the moving element 2 mutually separated by intermediate portions 66. These latter have in this embodiment a bearing function and can be geometrically coupled with relative support portions 67 configured in the case 220 of a switching device 3 in which the moving element 2 will be positioned. More precisely, the bearing portions 66 are configured so that once coupled with the corresponding support portions 67 they define a rotation axis 200 for the moving element 2.

FIG. 2 allows detailed observation of an electrical contact 1 relative to one of the housing units 25. The electrical contact 1 comprises a body 10 provided with a first contact portion 11 to which a contact plate 11B is preferably applied, intended for contacting a fixed contact 300 of the switching device 3. The body 10 of the electrical contact 1 also comprises a second portion 12 connectable with a conductive element 13 of the switching device 3.

The electrical contact 1 according to the invention also comprises a pin shaped portion 5 (well visible in FIGS. 3 and 4) positioned rotating in a seat 9 defined in the housing unit 25 of the moving element 2. In other words, once positioned in the seat 9 the pin-shaped end 5 can rotate, defining with this seat 9 a mutual rotation axis 101 for the electrical contact 1 with respect to the relative housing unit 25, or with respect to the moving element 2.

The electrical contact 1 according to the invention also comprises a coupling portion 5B susceptible to interact with the elastic element 50 housed in the housing unit 25. As mentioned above, the elastic element 50 exerts a force on the coupling portion 5B which constrains the electrical contact 1 against a mating surface 27 defined by the housing unit 25. In substance, this defines a pre-established position for the electrical contact 1 with respect to the housing seat 25.

With reference to the exploded view of FIG. 2, the body 10 of the electrical contact 1 presents a substantially flat configuration with a first side 10A and a second side 10B which extend on substantially parallel planes connected by a perimeter edge 14. The coupling portion 5B is defined by a hook-shaped portion of this perimeter edge 14. The pin portion 5 instead emerges according to a direction substantially orthogonal to the planes on which the sides 10A, 10B of the electrical contact 1 extend.

In an alternative embodiment to the one shown in the figures, the electrical contact 1 could comprise a pair of pin portions which emerge symmetrically from the sides of the shaped body 10 so as to configure the mutual rotation axis with respect to the moving element. More precisely, each of these pin portions would be positioned on relative symmetrical portions of the rotation seat 9.

According to a preferred embodiment of the invention, the body 10, the pin portion 5 and the coupling portion 5B of the electrical contact 1 are produced in one piece, for example by cold stamping of conductive metal material. The body 10 of the contact 1 could be produced in a single conductive material or could be "pluri-component", i.e. comprising portions produced in different materials, such as silver and tungsten carbide or alternatively silver and graphite. In this embodiment, the electrical contact 1 could be produced through a sintering process, for example according to methods illustrated in the patent application WO 2006/120140.

In an alternative embodiment to the one described above, the pin portion 5 could be defined through a pin coupled with the electrical contact 1 so as to emerge from one side of this contact. The pin could also support several mutually adjacent contacts defining a common rotation axis for the contacts. These latter would be relative to a same pole and therefore intended for a same housing unit, or intended for being supported by the same rotation seat. In an alternative embodiment, the electrical contacts 1 relative to a same pole could be operatively placed in different rotation seats defined inside a same housing unit.

Again with reference to the exploded view of FIG. 2, according to a preferred embodiment of the invention, the electrical contact 1 comprises a hollow portion 15 defined on at least one of the two sides 10A, 10B of the body 10. More precisely, this hollow portion 15 forms that part of the second portion 12 of the contact 1 intended for connection with a conductive element 13. This latter can be formed, for example, of a copper braid which is electrically connected to an electrode of the switching device 3.

Figure 3:
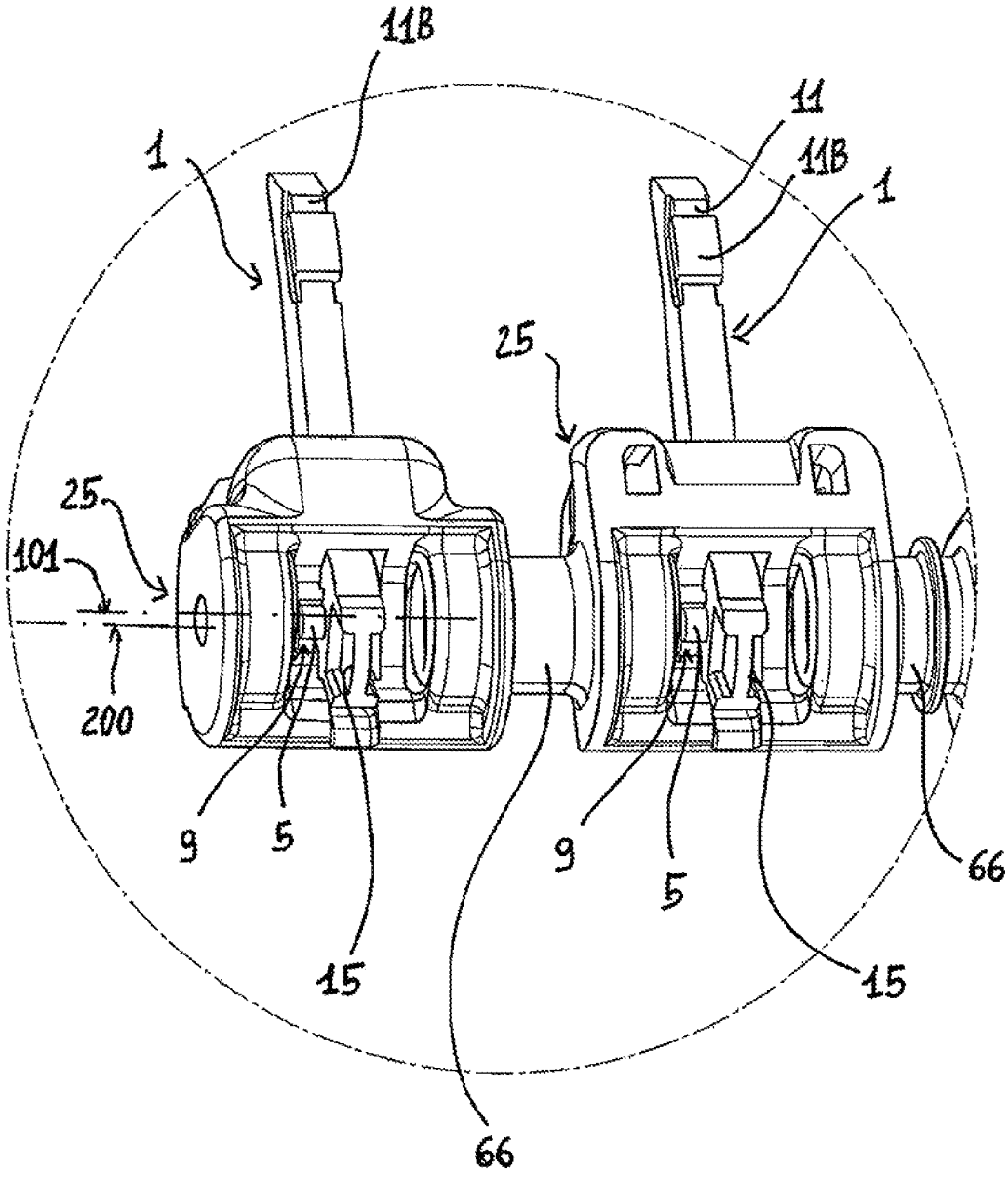
FIGS. 3 and 4 are detailed views relative to the moving element shown in FIGS. 1 and 2.
Figure 4:
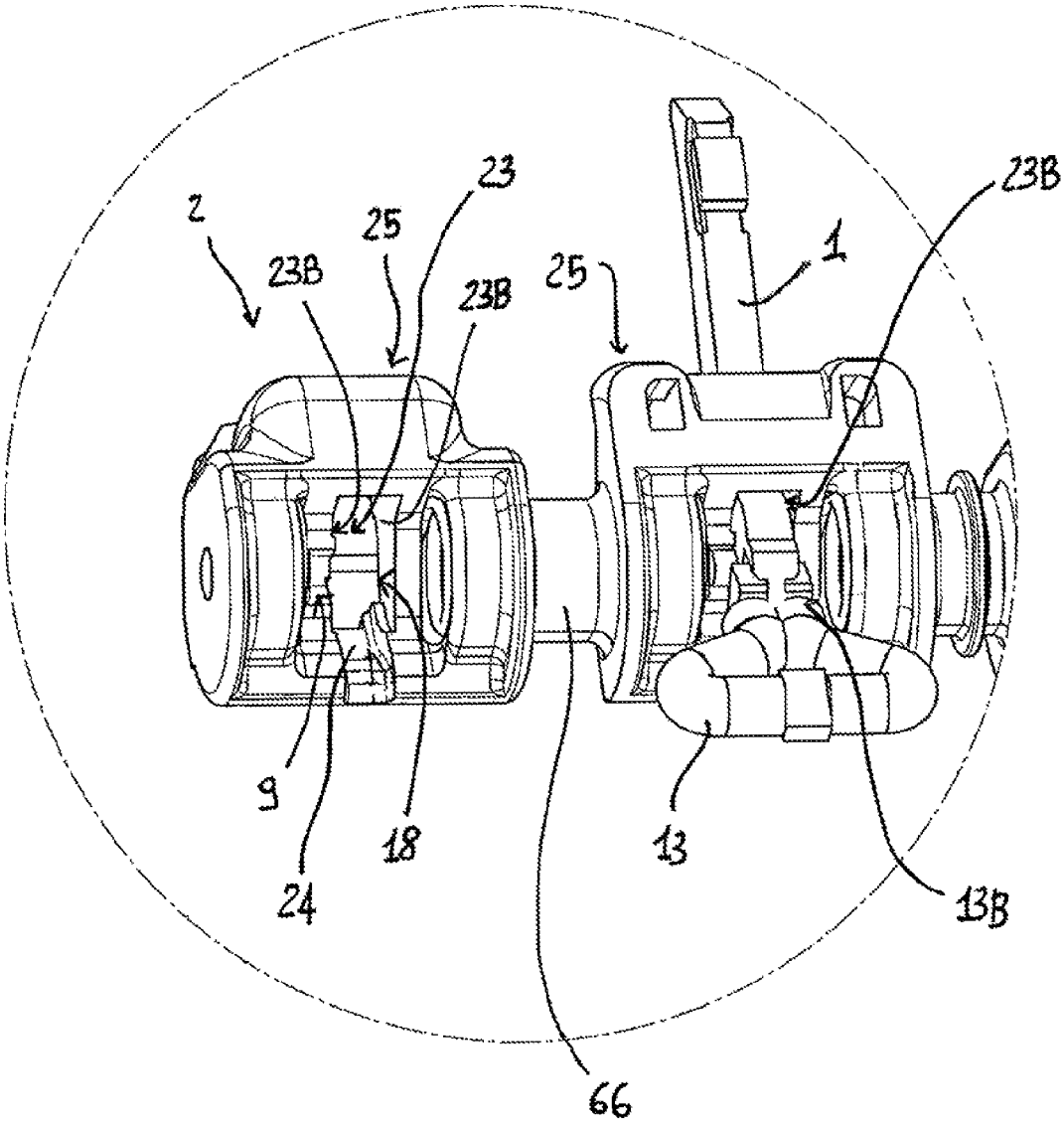

FIGS. 3 and 4 are detailed views of portions of the moving element 2 of FIG. 1. In particular, FIG. 3 shows two adjacent housing units 25 separated by an intermediate portion 66, which in this case configures a bearing element for rotation of the moving element in the body of the switch. Each unit 25 houses an electrical contact 1 whose pin portion 5 is placed in a rotating manner in the corresponding seat 9, so as to define the mutual rotation axis 101. As shown, the electrical contact 1 comprises a hollow portion 15 defined symmetrically on the two sides 10A, 10B of the electrical contact 1. With regard to this, the detailed view of FIG. 4 shows a possible embodiment of a conductive element 13, in this case flexible, the ends 13B of which are welded at opposite sides of the grooved portion 15.

Again with reference to FIG. 4, each housing unit 25 of the moving element 2 comprises a central cavity 18 in which the electrical contact 1 is inserted and in which the seat 9 for the pin portion 5 of this contact is defined. More precisely, the central cavity 18 is configured so as to be "through", extending between a first section, through which the electrical contact 1 is inserted, and a second section 2 through which the contact portion 11 exits once the electrical contact 1 is placed in its operating position, or once the pin portion 5 is positioned in a rotating manner in the relative seat 9.

In particular, the second section 23 is defined between a pair of parallel surfaces 23B which extend according to planes substantially orthogonal to the rotation axis 200 of the moving element 2. The two parallel surfaces 23B are axially spaced so as to maintain the electrical contact 1 in a stable position once it is operatively placed in the corresponding housing unit 25. In other words the axial distance of the parallel surfaces 23B and the thickness of the electrical contact 1 configure a coupling with clearance but sufficient to ensure stable movement of this contact 1 on a plane orthogonal to the axis 200 of the moving element 2.

Again with reference to the detailed view of FIG. 4, the central cavity 18 comprises a curved surface 24 in an arc of a circle which extends substantially at the base of the parallel portions 23B. This curved surface 24 presents a curvature corresponding to that of a curved portion 12B of the second portion 12 of the electrical contact 1 (see FIG. 2). Following positioning of the electrical contact 1, the curved portion 12B of the electrical contact 1 rests on the curved surface 24 which in practice forms a support saddle for rotation of the electrical contact 1. Naturally, this further stabilizes rotation of this latter, in other words increasing the reliability of the moving element 2.

Figure 6:
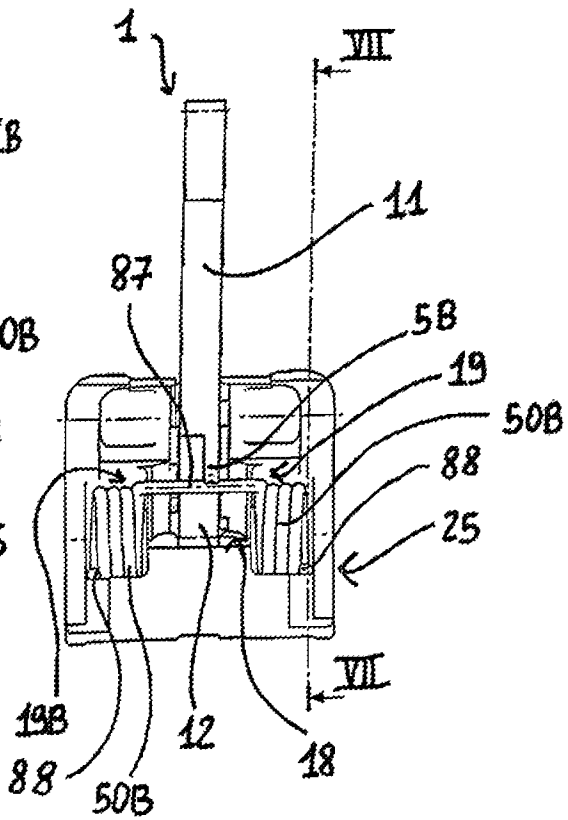
FIGS. 5 and 6 are views from different observation points of a housing unit of the moving element of FIG. 1 in a first operating configuration.
Figure 7:
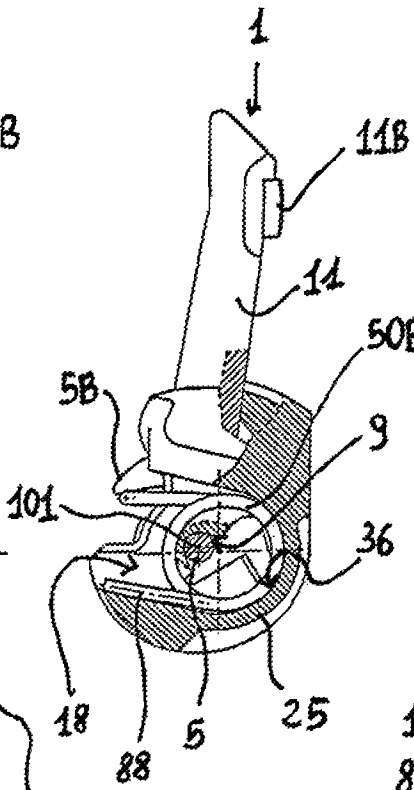
FIG. 7 is a sectional view according to the line VII-VII of FIG. 6.
Figure 5:
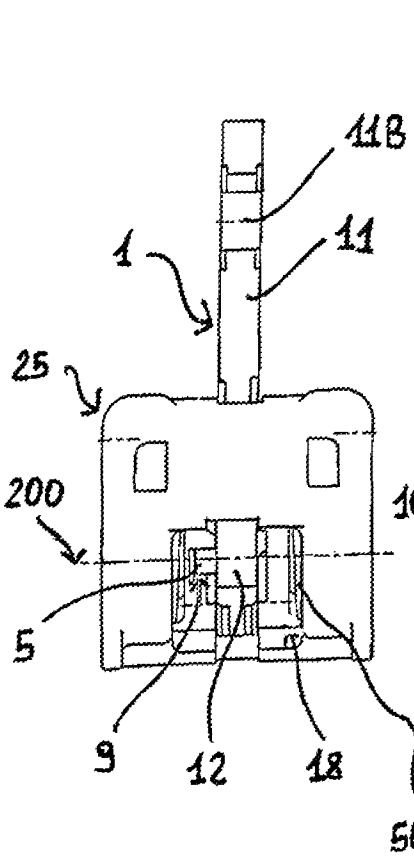

FIGS. 5 to 7 are relative to a housing unit 25 of the moving element 2 which has been shown in a separate manner mainly for descriptive purposes and to better identify other characteristics of the moving element 2.

FIG. 5 allows detailed observation of the seat 9 for rotation of the pin portion 5 of the electrical contact 1. FIG. 6 is instead a second view of the housing unit 25 from a second observation point substantially opposite the first. As shown, the housing unit 25 comprises a first lateral cavity 19 and a second lateral cavity 19B in which elastic portions 50B of an elastic element 50 are housed. More precisely, the lateral cavities 19, 19B are defined in symmetrical position with respect to the central cavity 18 and each comprise an opposing surface 33 (for example indicated in FIG. 8) for a free end 88 of one of the elastic portions 50B of the elastic element 50.

With reference also to the exploded view of FIG. 2, the elastic element 50 also comprises a bridge shaped portion 87 which is intended for intercepting the coupling end 5B of the electrical contact 1 once this assumes its operating position inside the central cavity 18. The elastic element 50 shown in the figures in practice forms a double helical spring with two symmetrical elastic portions 50B which extend along a main axis 150 and which are joined by a bridge portion 87 parallel to this main axis.

Figures 8, 9:
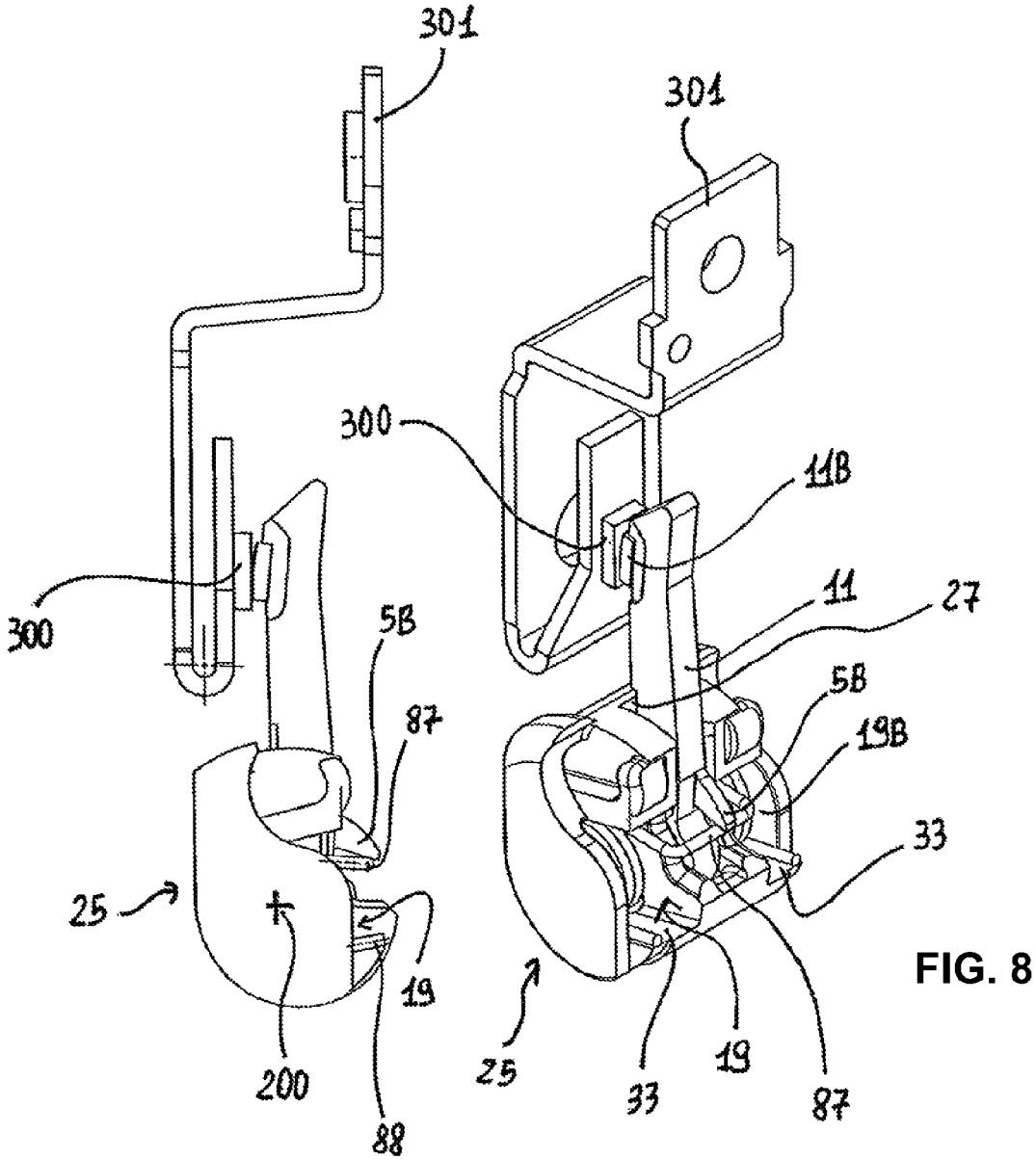
FIGS. 8 and 9 are views from different observation points of a pole formed by a fixed contact and by the moving element of FIG. 1 in a first operating configuration.

FIGS. 8 and 9 show a pole of a switching device relative to a moving element 2 according to the present invention. For the purposes of the present invention, the expression "pole" indicates a group of elements comprising a fixed contact 300 electrically connected to an electrical terminal 301, in turn connectable to an electric line. The "pole" comprises an electrical contact 1 and the relative housing unit 25 which receives it. The electrical contact 1, moving with respect to the housing unit 25, is also indicated below with the expression moving contact 1.

In FIGS. 8 and 9, the pole is shown in a first possible configuration in which the moving contact 1 is coupled with the fixed contact 300, i.e. the switching device 3 is closed. The moving element 2 reaches the position shown following an action of an actuating device 500 of the switch 3, or following a rotation about the longitudinal axis 200. The elastic element 50 acts on the coupling end 5B so as to maintain the electrical contact 1 in a pre-established position with respect to the housing unit 25 and to produce the desired contact pressure. More precisely, the bridge portion 87 of the elastic element 50 ensures that a portion of the perimeter edge 14 rests abutting against a mating surface 27 of the housing unit 25. In this condition the relative thrust that the moving contact receives from the fixed contact during closing opposes the action of the elastic element 50, detaching the electrical contact 1 from the mating surface 27.

Figure 10:
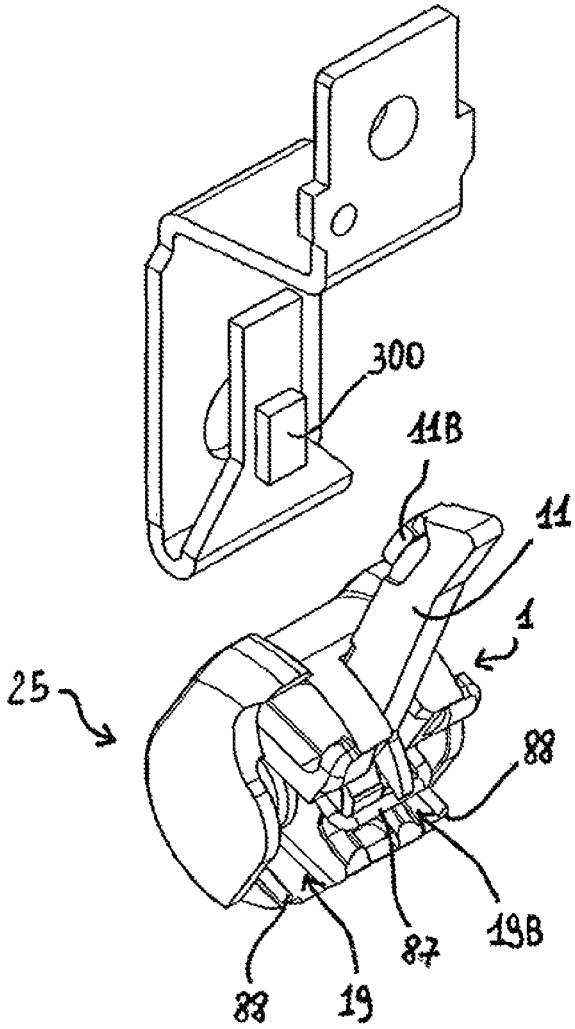
FIGS. 10 and 11 are views, from different observation points, of the pole of FIGS. 8 and 9 in a second operating configuration.
Figure 11:
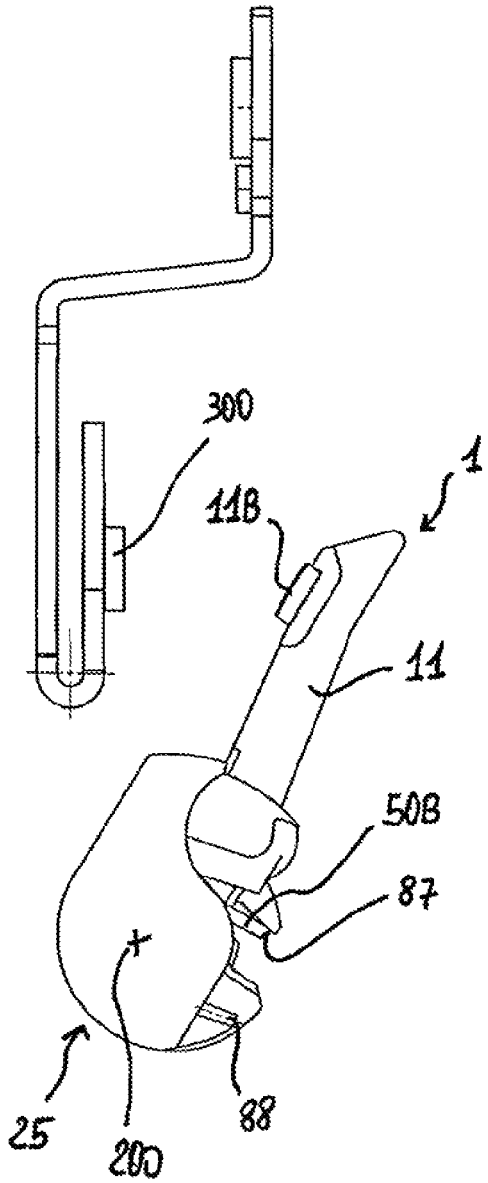

FIGS. 10 and 11 instead show the pole defined above in a second possible configuration in which the moving contact 1 is decoupled from the fixed contact. This condition in practice corresponds to an open state of the switching device and is achieved through rotation (clockwise) of the moving element 2 about its longitudinal axis 200 from the position shown in FIGS. 8 and 9.

By comparing FIGS. 10 and 11 and FIGS. 8 and 9 it can be seen that the electrical contact 1 is in a position only apparently identical with respect to the housing unit 25 passing from the open position to the closed configuration. The slight but significant different of position is clearly recognizable by comparing FIGS. 9 and 11, in which it can be seen that when the contact is open the spring 50 is at its maximum expansion, while when the contact is closed it is in a state of calibrated compression due to the slight backward rotation of the moving contact. In this second condition the action of the elastic element 50 is free to maintain the electrical contact 1 in contact with the mating surface 27.

Figure 12:
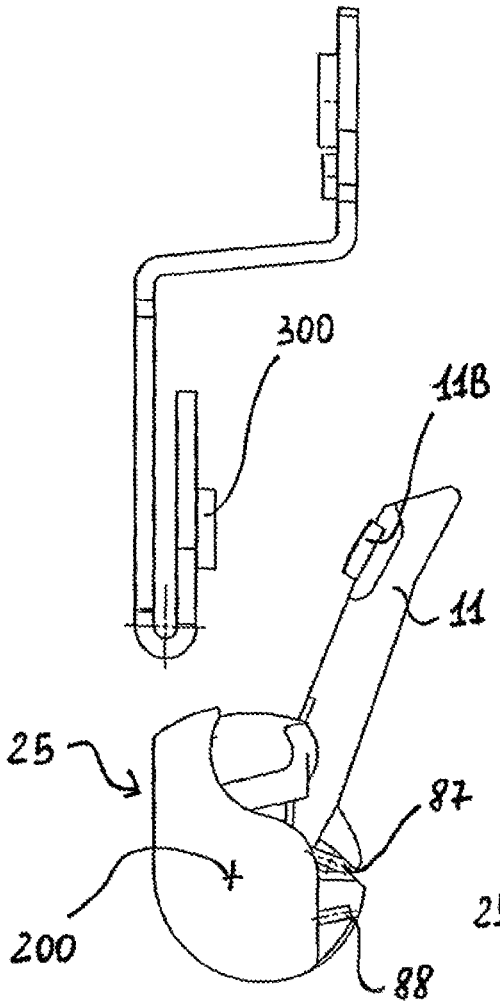
FIGS. 12 and 13 are views, from different observation points, of the pole of FIGS. 8 and 9 in a third operating configuration.
Figure 13:
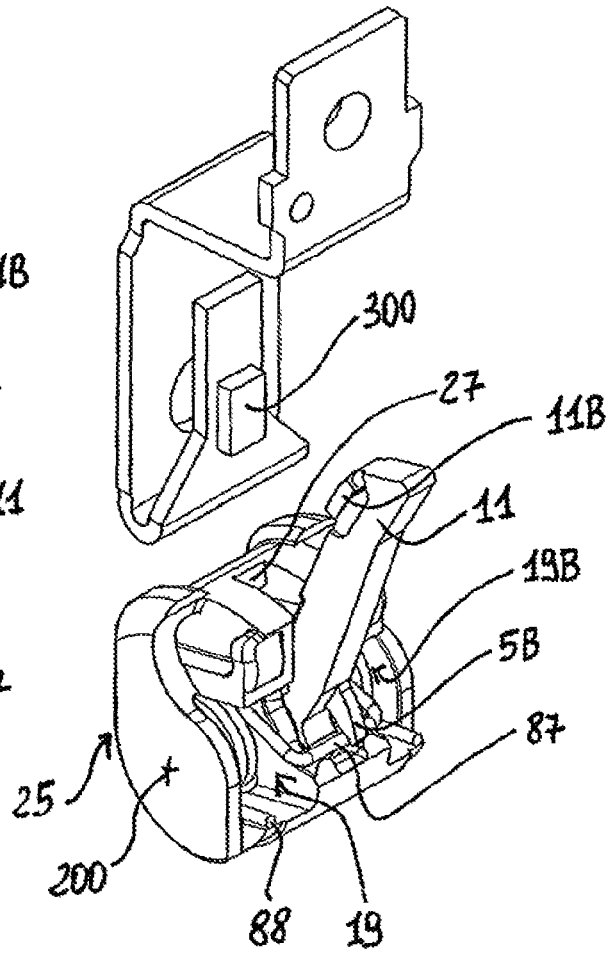

FIGS. 12 and 13 show the pole during the "repulsion" phase (also known as "overload" in the art), following which the moving contact 1 moves away from the fixed contact 300. In this third condition the housing unit 25 maintains a same position with respect to the condition with the contacts closed (FIGS. 8 and 9), while the moving contact 1 thrust by electrodynamic forces rotates variedly about the mutual rotation axis 101, moving away from the mating surface 27 opposing the action of the elastic element 50.

Figure 15:
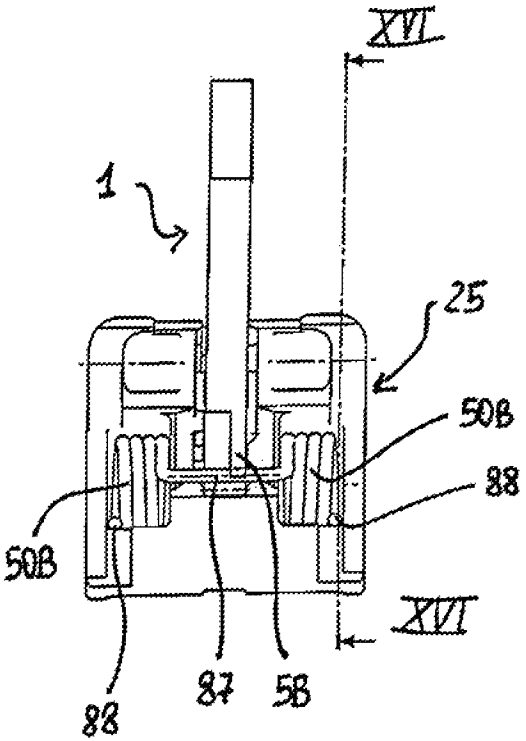
FIGS. 14 and 15 are further views of the moving element shown in FIGS. 12 and 13.
Figure 16:
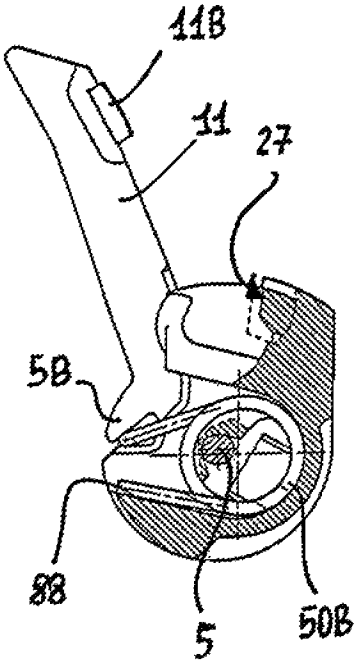
FIG. 16 is a sectional view according to the line XVI-XVI of FIG. 15.
Figure 14:
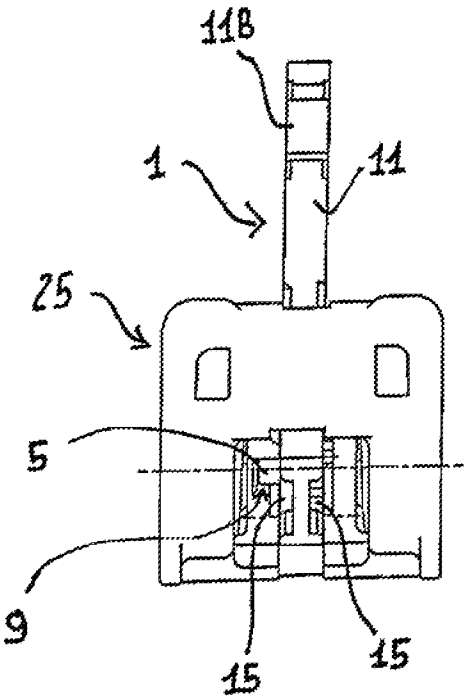

FIGS. 14 and 15 are further views of the pole during the repulsion phase of the contacts. FIG. 16 is a sectional view according to the line XVI-XVI of FIG. 15 and allows observation of the behavior of the elastic element 50 which opposes rotation of the electrical contact 1 during its repulsion. This opposing action stabilizes rotation of the electrical contact and allows it to return towards the mating surface 27 when the electrodynamic forces that cause repulsion are removed.

Figure 17:
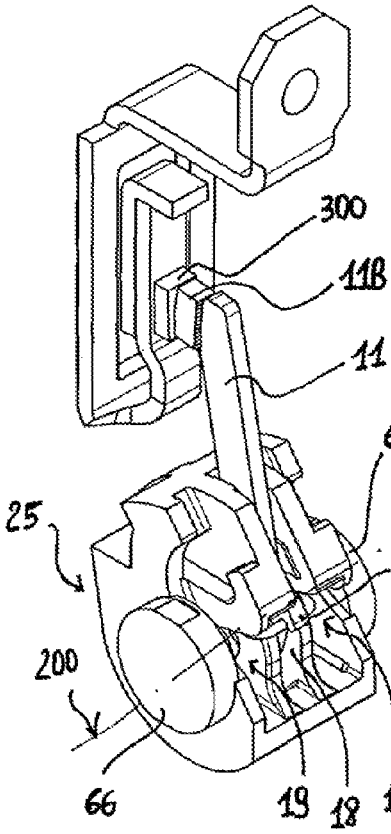
FIGS. 17 to 19 are views relative to a second electric pole comprising a fixed contact and a second embodiment of a moving element according to the present invention.
Figure 18:
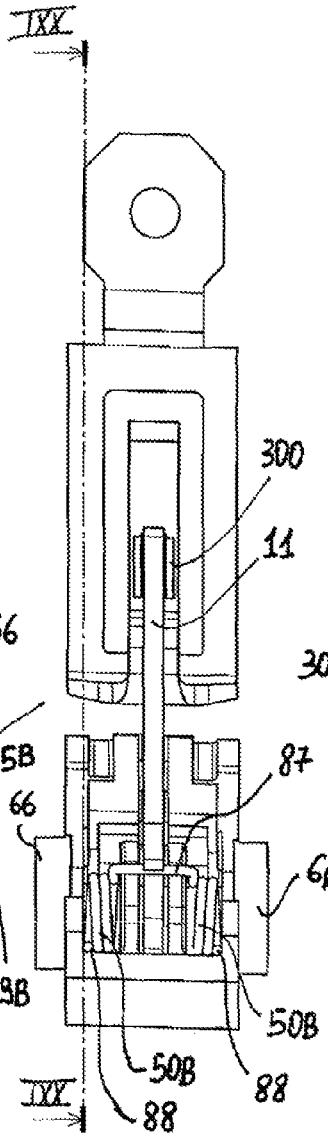
Figure 19:
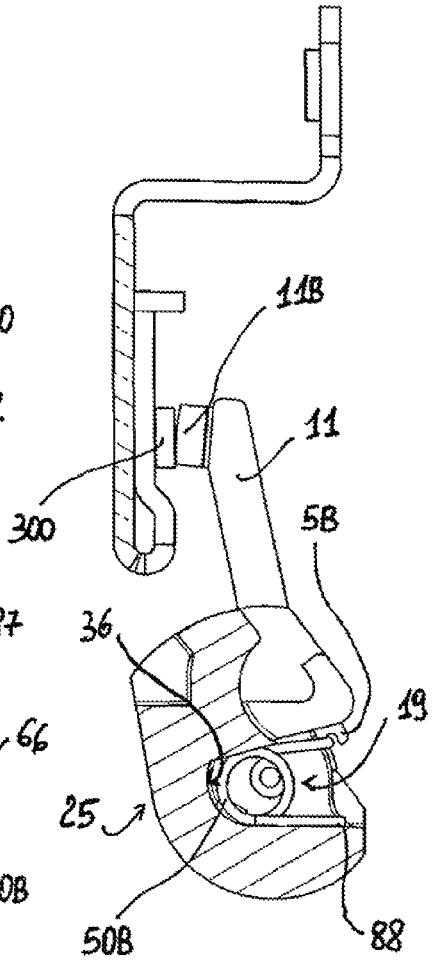

FIGS. 17 to 19 are views relative to a second embodiment of a pole of a switching device 3 according to the present invention. More precisely, this pole differs from the one shown in FIG. 5 to 16 due to a different configuration of the fixed contact 300 and due to a different configuration of the housing unit 25. These differences are justified by the fact that the two poles described here are relative to a switching devices with different performances both in terms of rated current and in terms of switching power (lower in this case).

More precisely, FIGS. 17 to 19 show the pole in the closed configuration, or in the position in which the electrical contact 1 is coupled with the fixed contact 300. FIG. 18 allows observation in particular of the structure of the lateral cavities 19, 19B in which the symmetrical portions 50B of the elastic element 50 are housed. FIG. 18 shows the two intermediate portions 66, with the function of bearing, which allow rotation of the moving element 2 about the axis 200.

FIG. 19 is a sectional view according to the line IXX of FIG. 8, and allows observation of the internal structure of one of the lateral cavities 19. The figure also shows the coupling end 5B which interacts with the bridge portion 87 of the elastic element 50. By comparing FIG. 19 and the sectional view of FIG. 7, it can be observed that the lateral cavity 19 presents a different configuration in the two cases. More precisely, in FIG. 7 the lateral cavity presents a substantially circular bottom wall 36 which thus recalls the configuration of the elastic portion 50B housed in this lateral cavity 19. In other words, the lateral cavity 19 is shaped in conformity with the elastic portion 50B.

Figures 20, 21, 22:
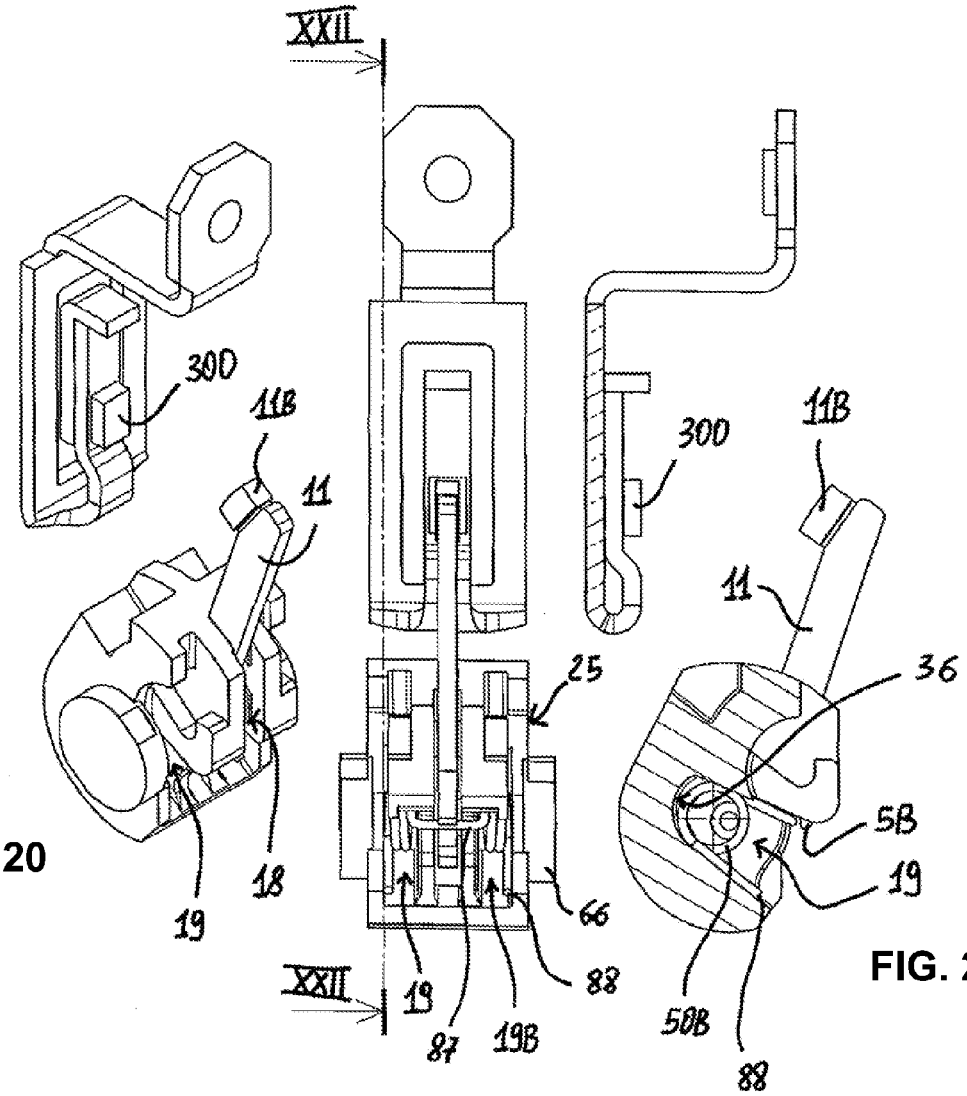
FIGS. 20 to 22 are views relative to the electric pole of FIGS. 17 to 19, in a different operating configuration.

Instead, in the solution shown in FIG. 22, although presenting a circular bottom wall 36, the lateral cavity 19 presents a considerably different curvature to that of the elastic portion 50B. It has been seen that this solution advantageously allows sliding of the elastic portion in the lateral cavity 19 during the repulsion phase of the contacts. In substance this sliding occurs as a relative movement of the corresponding elastic portion 50B on the opposing surface 33 of the lateral cavity. It has been seen that this facilitates response of the elastic element 50, as this adapts its position as a function of the intensity of repulsion.

FIGS. 20 to 22 are relative to the pole shown in FIGS. 17 to 19 in the open configuration, that is, such that the moving contact 1 is separated from the fixed contact 300. In particular, by comparing FIG. 19 and FIG. 22, the different position of the housing unit 25 with respect to the fixed contact 300 can be observed. In fact, as indicated above, passage from the configuration with the contacts coupled to that with the contact closed takes place through rotation of the moving element 2 about its rotation axis 200 following actuation of an actuating mechanism 500. By comparing FIGS. 19 and 22 it can also be seen that the moving contact is in different relative positions with respect to the moving element (in closed position a slight detachment from the mating surface 27 can be observed, ensuring that the elastic element 50 exerts pressure against the fixed contact).

Figures 23, 24, 25:
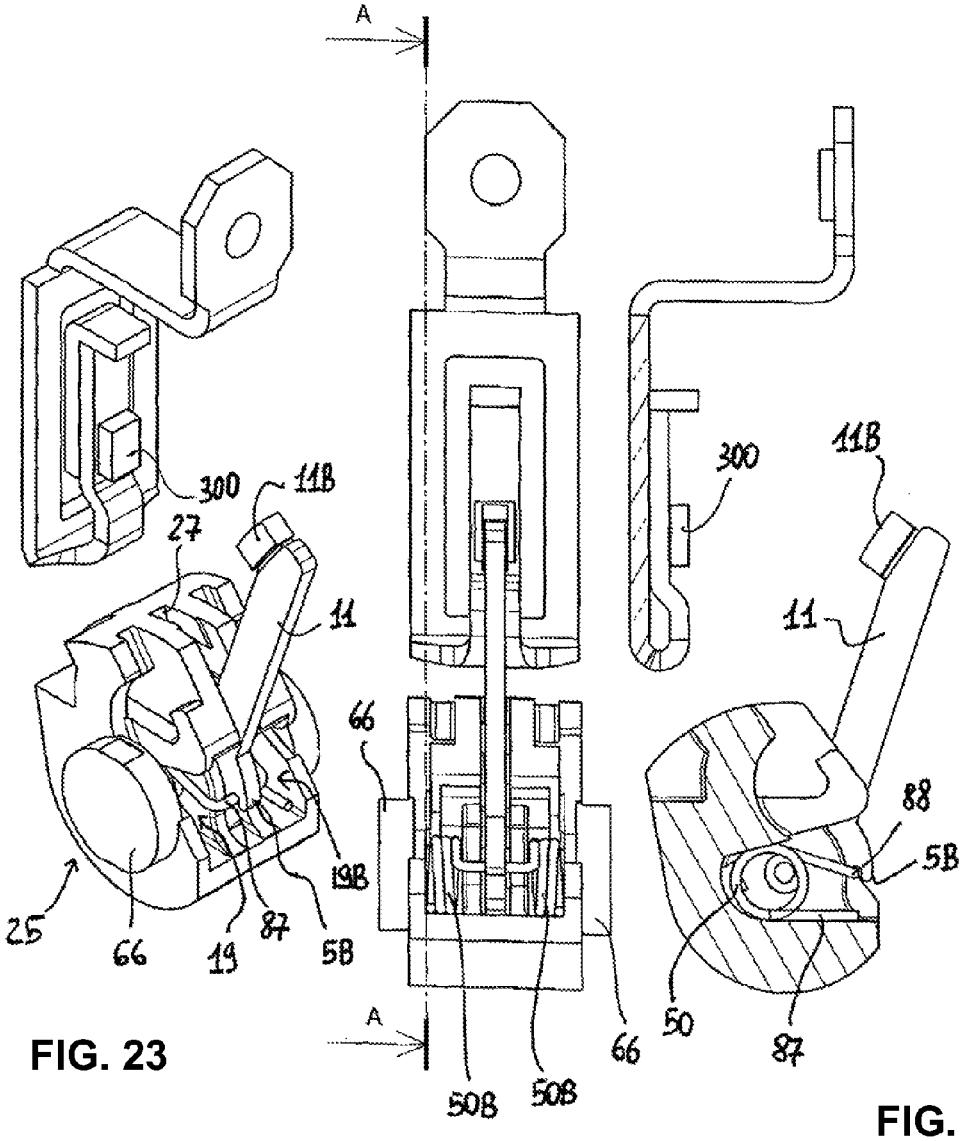
FIGS. 23 to 25 are views relative to the electric pole of FIGS. 20 to 22, in a further operating configuration.

FIGS. 23 to 25 are instead relative to the pole shown in FIGS. 17 to 22 during the repulsion phase of the contacts. As can be observed in this position, the moving element 2, or the housing unit 25 maintains the position occupied in the condition with the contacts coupled (FIGS. 17 to 19), while the moving contact 1 moves away from the fixed contact 300, opposed in its rotation by the elastic element 50 at the coupling portion 5B. The sectional view of FIG. 25 shows compression of the elastic element 50, for example with respect to the completely extended condition shown in FIG. 22.

Figure 26:
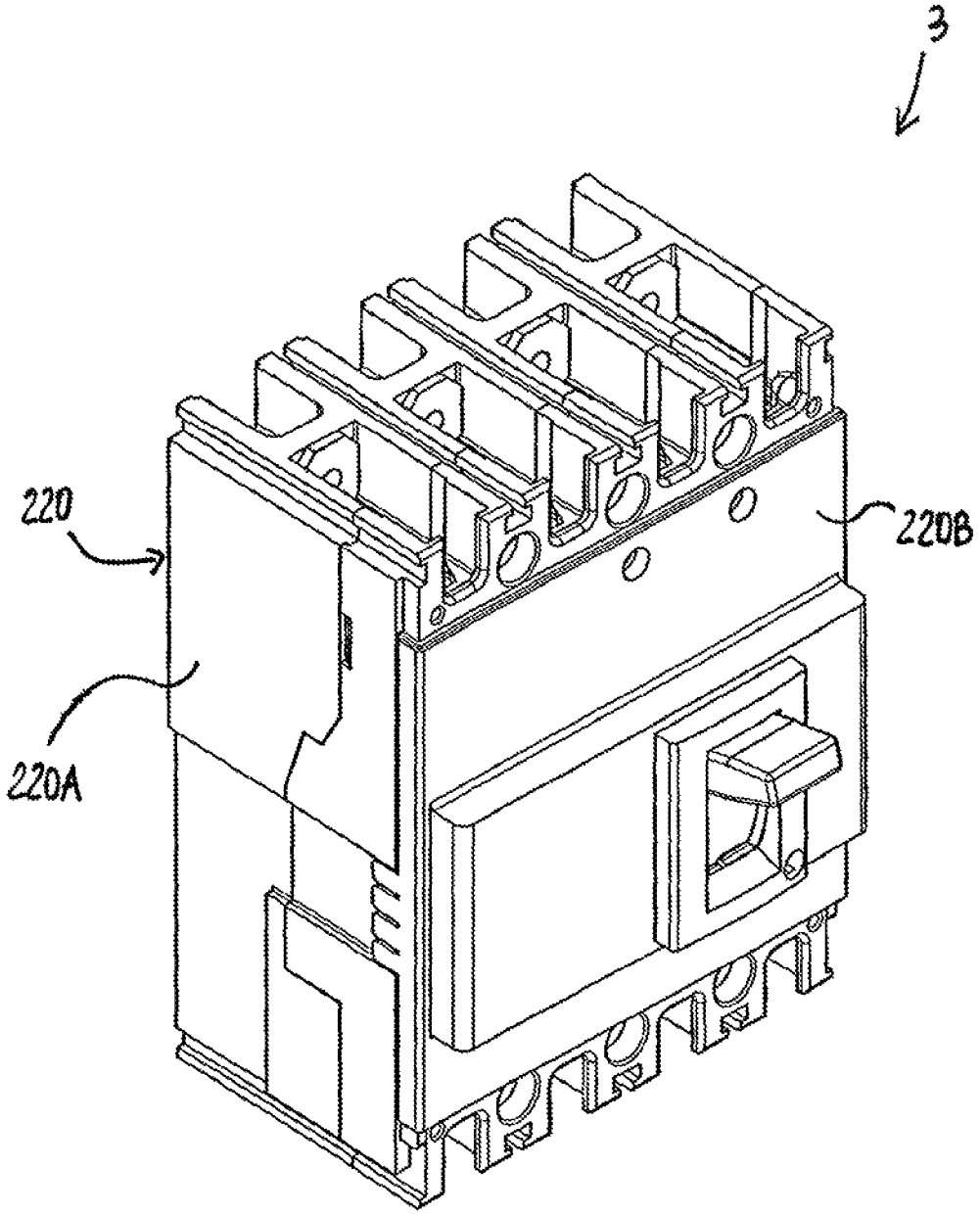
FIG. 26 is a first perspective view of a switching device comprising a moving element according to the present invention.
Figure 27:
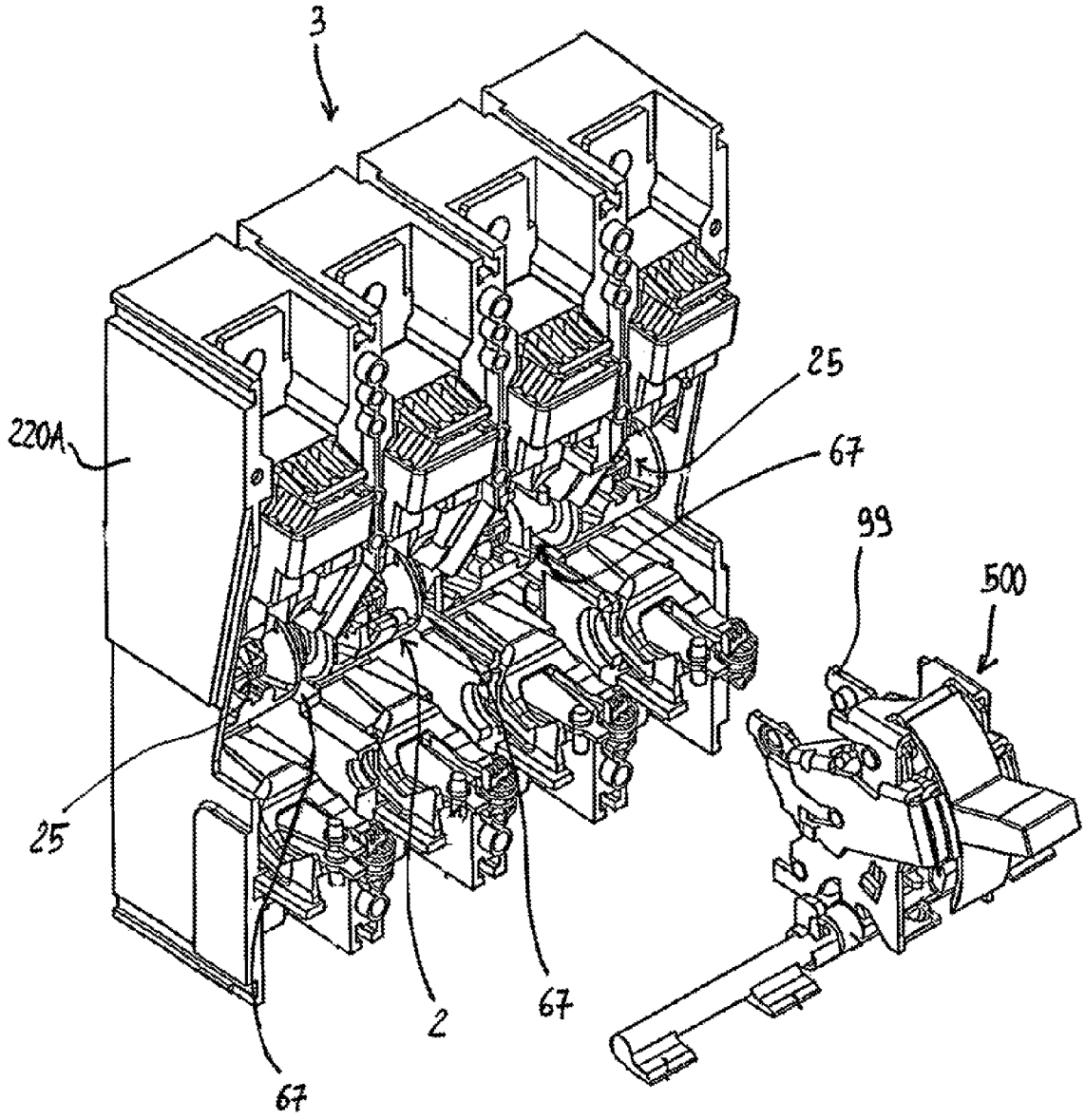
FIG. 27 is an exploded view of the switching device of FIG. 26.

The present invention also relates to a switching device 3 comprising a moving element 2 according to the present invention. In this regard, FIGS. 26 and 27 are respectively a perspective view and an exploded view of a switching device 3 according to the present invention. The switching device 1 comprises an external case 220A, 220B, containing for each pole at least one fixed contact 300 and at least one moving contact 1 which can be coupled with and decoupled from each other. The switching device 3 comprises a moving element 2 according to the present invention provided with a plurality of housing units 25 each of which houses a moving contact 1 having the distinctive features indicated above. The moving element 2 is moved through an actuating mechanism 500 which causes it to rotate about its rotation axis 200.

The perspective view of FIG. 26 allows observation of the structure of the case 220 which is composed of a box 220A to which a cover 220B is connected. The box 220A and the cover 220B are structured internally so as to define support portions 67 shaped to support corresponding bearing portions 66 of the moving element 2, or so as to define a rotation axis 200 for this element.

FIG. 27 is an exploded view of the switching device 3 in which the moving element 2 is shown in its operating position. As indicated, the switching device 3 also comprises an actuating mechanism 500 which is operatively connected to the moving element 2 through a connecting rod 99, which is also visible in FIGS. 1 and 2. The connecting rod 99 presents a structure formed by a pair of opposed lateral portions 99B connected transversely by a transverse connection portion 99C. A pin end 77 emerges from the inner side of each lateral portion 99B. The two pin ends 77 emerge in opposite positions so as to configure a mutual rotation axis.

With reference to FIG. 2, one of the housing units 25 of the moving element 2 comprises a pair of symmetrical portions configured so that each defines a rotation seat for one of the pin ends 77 of the connecting rod 99 of the actuating mechanism 500. These portions are symmetrical with respect to the central cavity 18 of the housing unit 25 and are configured so that the pin ends 77 cannot exit from the rotation seats once the connecting rod 99 has been placed in its operating position.

The use of pin ends 77 to connect the connecting rod to the moving element makes it possible to completely eliminate the use of longitudinal pins to produce the moving element 2, with obvious advantages both from the viewpoint of facilitating production of the parts forming the element and from the viewpoint of assembly times, or of final production costs.

The technical solutions adopted for the moving element according to the invention allow the aim set to be fully achieved. In particular, the structure thereof allows a drastic reduction of assembly times with respect to conventional solutions. Moreover, the moving element is reliable and easy to produce at extremely competitive costs. Advantageously, its structure has no longitudinal pins and this solves the problems of electrical insulation which currently affect these components.

The moving element thus conceived is susceptible to numerous modifications and variants, all falling within the inventive concept; moreover all details can be replaced by other technically equivalent details.

In practice, the materials used and the contingent dimensions and forms can be any, according to requirements and to the state of the art.

The invention claimed is:

1. A moving element for a low voltage switching device, said element comprising for each pole a rotatable housing unit suitable to receive an elastic element which interacts with an electrical contact, said electrical contact comprising a first contact portion susceptible to contact a further electrical contact and a second portion connectable to a conductive element of said switching device, characterized in that said electrical contact comprises a pin shaped portion positioned rotating in a seat defined on said housing unit so as to configure a mutual rotation axis of said electrical contact with respect to said housing unit said mutual rotation axis being different from a first rotation axis;

said moving element is configured to rotate about said first rotation axis to couple/decouple said electrical contact with/from said further electric contact;

wherein the moving element has three operating positions, including a closed position, and open position, and an overload position;

wherein said elastic element exerts a force on said electrical contact to push said electrical contact against a mating surface of said housing;

wherein said electrical contact changes its position with respect to said housing unit when passing from the open or overload position to the closed position by performing a backward rotation when said electrical contact couples with the further electric contact, said electrical contact separating from said mating surface as a consequence of said backward rotation;

wherein said elastic element is a spring, which is at its maximum expansion, when said electrical contact is in the open position, and which is in a state of compression due to a rotation of said electrical contact, when said electrical contact is closed;

wherein the housing unit rotates relative to the further electrical contact.

2. The moving element as claimed in claim 1, wherein said electrical contact comprises a coupling portion which interacts with said elastic element.

3. The moving element as claimed in claim 2, wherein said electrical contact comprises a body having a first side and a second side which extend on substantially parallel planes and a perimeter edge which extends between said first and said second side, said coupling portion being defined by a portion of said perimeter edge.

4. The moving element as claimed in claim 1, wherein said rotation seat is defined in a central cavity of said housing unit.

5. The moving element as claimed in claim 4, wherein said central cavity extends between a first section, through which said electrical contact is inserted, and a second section through which said contact portion exits once said electrical contact has been inserted.

6. The moving element as claimed in claim 5, wherein said elastic element comprises symmetrical portions housed in a first and a second lateral cavity of said housing unit, said lateral cavities being defined in a symmetrical position with respect to said central cavity and each comprising an opposing surface for a free end of one of said portions of said elastic element.

7. The moving element as claimed in claim 6, wherein said elastic element comprises a pair of symmetrical elastic portions which extend along a main axis and which are mutually connected by a bridge portion which interacts with said coupling portion once said symmetrical portions are housed in the relative lateral cavities.

8. The moving element as claimed in claim 1, wherein said moving element comprises a plurality of housing units mutually separated by bearing portions suitable to couple with relative support portions defined by said switching device.

9. The moving element as claimed in claim 2, wherein said rotation seat is defined in a central cavity of said housing unit.

10. The moving element as claimed in claim 3, wherein said rotation seat is defined in a central cavity of said housing unit.

11. The moving element as claimed in claim 2, wherein said moving element comprises a plurality of housing units mutually separated by bearing portions suitable to couple with relative support portions defined by said switching device.

12. The moving element as claimed in claim 3, wherein said moving element comprises a plurality of housing units mutually separated by bearing portions suitable to couple with relative support portions defined by said switching device.

13. The moving element as claimed in claim 4, wherein said moving element comprises a plurality of housing units mutually separated by bearing portions suitable to couple with relative support portions defined by said switching device.

14. The moving element as claimed in claim 5, wherein said moving element comprises a plurality of housing units mutually separated by bearing portions suitable to couple with relative support portions defined by said switching device.

15. The moving element as claimed in claim 6, wherein said moving element comprises a plurality of housing units mutually separated by bearing portions suitable to couple with relative support portions defined by said switching device.

16. The moving element as claimed in claim 7, wherein said moving element comprises a plurality of housing units mutually separated by bearing portions suitable to couple with relative support portions defined by said switching device.

17. The moving element as claimed in claim 9, wherein said central cavity extends between a first section, through which said electrical contact is inserted, and a second section through which said contact portion exits once said electrical contact has been inserted.

18. An electrical contact for a low voltage switching device, comprising:

a fixed contact;

a rotatable contact arm rotatable about a first axis, having a first contact configured to selectively engage and disengage the fixed contact;

a rotatable housing rotatable about a second axis different from the first axis, the contact arm being seated in the housing unit;

a spring mounted in the housing, the spring biasing the first contact into a direction of engagement with the fixed contact;

the electrical contact having:

a closed position in which the first contact is engaged with the fixed contact and the housing is in a first position;

an open position in which the first contact is disengaged from the fixed contact and the housing is in the first position;

an overload position in which the first contact is disengaged from the fixed contact and the housing is in a second position;

wherein during transition from the closed position to the open position the contact arm rotates away from the fixed arm about the first axis while the housing maintains the first position;

wherein during transition from the closed position to the overload position the housing rotates from the first position to the second position about the second axis to move the contact arm away from the fixed contact, and the first contact rotates toward the fixed contact about the first axis to partially offset movement of the housing.

19. The electrical contact of claim 1, wherein amongst the open, closed and overload position, the spring is in a least compressed state in the open position.

20. The electrical contact of claim 18, wherein amongst the open, closed and overload position, the spring is in a most compressed state in the overload position.

* * * * *